US010371417B2

(12) United States Patent
Xu et al.

(10) Patent No.: US 10,371,417 B2
(45) Date of Patent: Aug. 6, 2019

(54) CRYOCOOLER AND ROTARY VALVE MECHANISM

(71) Applicant: SUMITOMO HEAVY INDUSTRIES, LTD., Tokyo (JP)

(72) Inventors: Mingyao Xu, Nishitokyo (JP); Takaaki Morie, Yokosuka (JP); Qian Bao, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 194 days.

(21) Appl. No.: 15/436,503

(22) Filed: Feb. 17, 2017

(65) Prior Publication Data

US 2017/0241674 A1 Aug. 24, 2017

(30) Foreign Application Priority Data

Feb. 18, 2016 (JP) ..... 2016-029022

(51) Int. Cl.
*F25B 9/14* (2006.01)

(52) U.S. Cl.
CPC ..... *F25B 9/145* (2013.01); *F25B 9/14* (2013.01); *F25B 2309/006* (2013.01); *F25B 2309/1406* (2013.01); *F25B 2309/14181* (2013.01)

(58) Field of Classification Search
CPC .. F25B 9/14; F25B 9/145; F25B 2309/14181; F25B 2309/006; F25B 2309/1418; F16K 25/00; F16K 25/005
See application file for complete search history.

(56) References Cited

U.S. PATENT DOCUMENTS

| | | | | |
|---|---|---|---|---|
| 7,654,096 | B2 | 2/2010 | Xu et al. | |
| 9,657,970 | B2 | 5/2017 | Morie et al. | |
| 2002/0066276 | A1* | 6/2002 | Kawano | F16K 11/074 62/6 |
| 2003/0089116 | A1* | 5/2003 | Heron | F16K 3/188 62/6 |
| 2013/0025297 | A1* | 1/2013 | Matsubara | F16K 25/005 62/6 |

FOREIGN PATENT DOCUMENTS

| | | | |
|---|---|---|---|
| JP | 2005-076894 | A | 3/2005 |
| JP | 3635767 | B2 | 4/2005 |
| JP | 4684239 | B2 | 5/2011 |
| JP | 2014-224656 | A | 12/2014 |

* cited by examiner

*Primary Examiner* — Brian M King
(74) *Attorney, Agent, or Firm* — HEA Law PLLC

(57) ABSTRACT

A rotary valve mechanism includes a valve stator having a stator recessed portion and a valve rotor having a rotor recessed portion. The rotor recessed portion is formed in the valve rotor such that a rotor-recessed-portion front edge line passes through a stator-recessed-portion front edge line and the rotor recessed portion fluidally communicates with the stator recessed portion at a first phase of rotary-valve-mechanism rotation, and a rotor-recessed-portion rear edge line passes through a stator-recessed-portion rear edge line and the rotor recessed portion is fluidally separated from the stator recessed portion at a second phase thereof, and a shape of the rotor-recessed-portion front edge line coincides with a shape of the stator-recessed-portion front edge line such that the rotor-recessed-portion front edge line overlaps the stator-recessed-portion front edge line at the first phase.

10 Claims, 6 Drawing Sheets

CRYOCOOLER AND ROTARY VALVE MECHANISM

INCORPORATION BY REFERENCE

Priority is claimed to Japanese Patent Application No. 2016-029022, filed Feb. 18, 2016, the entire content of which is incorporated herein by reference.

BACKGROUND

Technical Field

Certain embodiments of the present invention relate to cryocoolers and cryocooler rotary valve mechanisms.

Description of Related Art

A cryocooler represented by a Gifford-McMahon (GM) cryocooler includes an expander and a compressor of a working gas (also referred to as refrigerant gas). In most cases, the expander includes a displacer that is axially reciprocated by a driving means, and a regenerator that is built into the displacer. The displacer is accommodated in a cylinder that guides the reciprocation. A variable volume formed between the cylinder and the displacer, and generated by the relative movement of the displacer with respect to the cylinder is used as an expansion chamber for the working gas. The expander can give rise to coldness by appropriately synchronizing volume and pressure changes of the expansion chamber.

Accordingly, the cryocooler includes a valve component for controlling the pressure of the expansion chamber. The valve component is configured so as to alternately switch between supply of high-pressure working gas from the compressor to the expander, and recovery of low-pressure working gas from the expander to the compressor. In general, a rotary valve mechanism is used as the valve component. Such valve components are also included in other cryocoolers such as pulse-tube cryocoolers.

SUMMARY

According to an aspect of the present invention, there is provided a cryocooler, including: a compressor of a working gas which includes a compressor discharging port and a compressor suction port; an expander which includes a gas expansion chamber, and a low-pressure gas chamber which communicates with the compressor suction port; a valve stator which includes a stator plane perpendicular to a valve-rotational axis, a high-pressure gas inflow port which is open to the stator plane and communicates with the compressor discharging port, and a stator recessed portion which defines a stator-recessed-portion front edge line and a stator-recessed-portion rear edge line positioned so as to be separated from each other in a valve-rotational direction on the stator plane and communicates with the gas expansion chamber, and is disposed in the low-pressure gas chamber; and a valve rotor which includes a rotor plane which is perpendicular to the valve-rotational axis and is in surface-contact with the stator plane and a rotor recessed portion which defines a rotor-recessed-portion front edge line and a rotor-recessed-portion rear edge line positioned so as to be separated from each other in a valve-rotational direction on the rotor plane and communicates with the high-pressure gas inflow port, and is disposed in the low-pressure gas chamber so as to rotate around the valve-rotational axis with respect to the valve stator. The rotor recessed portion is formed in the valve rotor such that the rotor-recessed-portion front edge line passes through the stator-recessed-portion front edge line and the rotor recessed portion fluidally communicates with the stator recessed portion at a first phase of a valve rotation and the rotor-recessed-portion rear edge line passes through the stator-recessed-portion rear edge line and the rotor recessed portion is fluidally separated from the stator recessed portion at a second phase of the valve rotation, and a shape of the rotor-recessed-portion front edge line coincides with a shape of the stator-recessed-portion front edge line such that the rotor-recessed-portion front edge line overlaps the stator-recessed-portion front edge line at the first phase.

According to another aspect of the present invention, there is provided a rotary valve mechanism of a cryocooler, including: a valve stator which includes a stator plane perpendicular to a valve-rotational axis and a stator recessed portion which defines a stator-recessed-portion front edge line and a stator-recessed-portion rear edge line positioned so as to be separated from each other in a valve-rotational direction on the stator plane, and is a portion of a working gas flow path of a cryocooler; and a valve rotor which includes a rotor plane which is perpendicular to the valve-rotational axis and is in surface-contact with the stator plane and a rotor recessed portion which defines a rotor-recessed-portion front edge line and a rotor-recessed-portion rear edge line positioned so as to be separated from each other in a valve-rotational direction on the rotor plane and is a portion of the working gas flow path of the cryocooler, and is disposed so as to rotate around the valve-rotational axis with respect to the valve stator. The rotor recessed portion is formed in the valve rotor such that the rotor-recessed-portion front edge line passes through the stator-recessed-portion front edge line and the rotor recessed portion fluidally communicates with the stator recessed portion at a first phase of a valve rotation and the rotor-recessed-portion rear edge line passes through the stator-recessed-portion rear edge line and the rotor recessed portion is fluidally separated from the stator recessed portion at a second phase of the valve rotation, and a shape of the rotor-recessed-portion front edge line coincides with a shape of the stator-recessed-portion front edge line such that the rotor-recessed-portion front edge line overlaps the stator-recessed-portion front edge line at the first phase.

DETAILED DESCRIPTION

Figure 1:
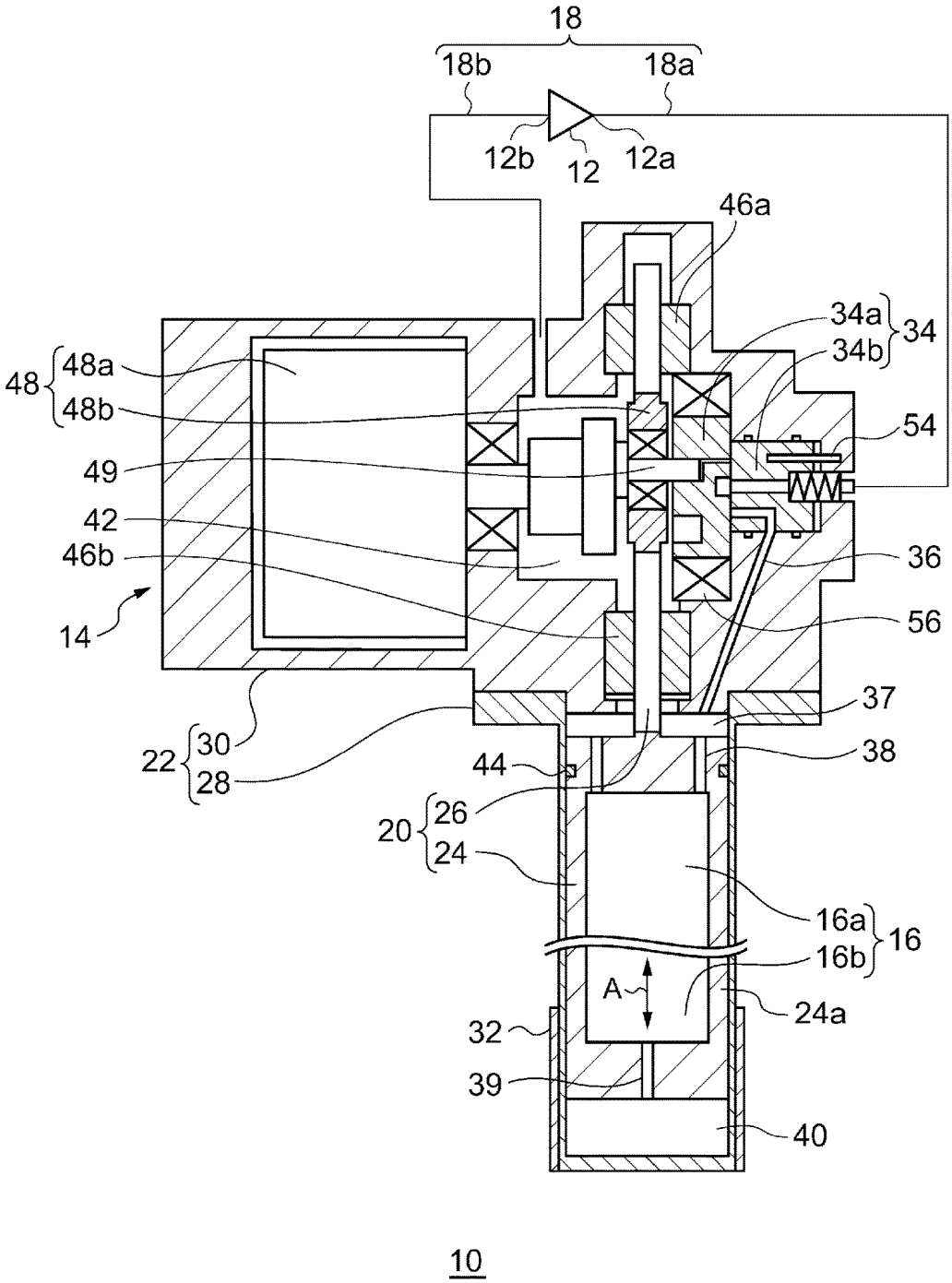
FIG. 1 is a view schematically showing the entire configuration of a cryocooler according to an embodiment of the present invention.

It is desirable to reduce a pressure loss in a rotary valve mechanism of a cryocooler.

In addition, components or expression of the present invention may be replaced by each other in methods, devices, systems, or the like, and these replacements are also included in aspects of the present invention.

According to the present invention, it is possible to reduce a pressure loss in a rotary valve mechanism of a cryocooler.

Hereinafter, embodiments of the present invention will be described in detail with reference to the drawings. In addition, in descriptions thereof, the same reference numerals are assigned to the same elements, and overlapping descriptions are appropriately omitted. Moreover, configurations described below are exemplified and do not limit the scope of the present invention.

FIG. 1 is a view schematically showing a cryocooler 10 according to an embodiment of the present invention. The cryocooler 10 includes a compressor 12 which compresses a working gas and an expander 14 which cools the working gas by adiabatic expansion. For example, the working gas is helium gas. The expander 14 may be also referred to as a cold head.

A regenerator 16 which pre-cools the working gas is included in the expander 14. The cryocooler 10 includes a gas pipe 18 which includes a first pipe 18*a* and a second pipe 18*b* which are respectively connected to the compressor 12 and the expander 14. The shown cryocooler 10 is a single-staged GM cryocooler.

As is well known, a working gas having a first high pressure is supplied from a discharging port 12*a* of the compressor 12 to the expander 14 through the first pipe 18*a*.

The pressure of the working gas is decreased from the first high pressure to a second high pressure which is lower than the first high pressure due to adiabatic expansion in the expander 14. The working gas having the second high pressure is returned from the expander 14 to a suction port 12*b* of the compressor 12 through the second pipe 18*b*. The compressor 12 compresses the returned working gas having the second high pressure. Accordingly, the pressure of the working gas increases to the first high pressure again. In general, the first high pressure and the second high pressure are significantly higher than the atmospheric pressure. For convenience of descriptions, the first high pressure and the second high pressure are simply referred to as a high pressure and a low pressure, respectively. Typically, for example, the high pressure is 2 to 3 MPa, and the low pressure is 0.5 to 1.5 MPa. For example, a difference between the high pressure and the low pressure is approximately 1.2 to 2 MPa.

The expander 14 includes an expander movable portion 20 and an expander stationary portion 22. The expander movable portion 20 is configured so as to reciprocate in an axial direction (up-down direction in FIG. 1) with respect to the expander stationary portion 22. The movement direction of the expander movable portion 20 is indicated by an arrow A in FIG. 1. The expander stationary portion 22 is configured so as to support the expander movable portion 20 to reciprocate in the axial direction. In addition, the expander stationary portion 22 is configured of an airtight container in which the expander movable portion 20 is accommodated along with a high-pressure gas (including first high-pressure gas and second high-pressure gas).

The expander movable portion 20 includes a displacer 24 and a displacer drive shaft 26 which reciprocates the displacer 24. A regenerator 16 is built in the displacer 24.

The displacer 24 includes a displacer member 24*a* which surrounds the regenerator 16. An internal space of the displacer member 24*a* is filled with a regenerator material. Accordingly, the regenerator 16 is formed inside the displacer 24. For example, the displacer 24 has a substantially columnar shape which extends in the axial direction. The displacer member 24*a* includes an outer diameter and an inner diameter which are substantially constant in the axial direction. Accordingly, the regenerator 16 also has a substantially columnar shape which extends in the axial direction.

The expander stationary portion 22 approximately has two configurations which includes a cylinder 28 and a drive mechanism housing 30. The upper portion of the expander stationary portion 22 in the axial direction is the drive mechanism housing 30, the lower portion of the expander stationary portion 22 in the axial direction is the cylinder 28, and the drive mechanism housing 30 and the cylinder 28 are firmly connected to each other. The cylinder 28 is configured to guide the reciprocation of the displacer 24. The cylinder 28 extends in the axial direction from the drive mechanism housing 30. The cylinder 28 has an inner diameter which is substantially constant in the axial direction. Accordingly, the cylinder 28 has a substantially cylindrical inner surface which extends in the axial direction. The inner diameter is slightly greater than the outer diameter of the displacer member 24*a*.

Moreover, the expander stationary portion 22 includes a cooling stage 32. The cooling stage 32 is fixed to the terminal of the cylinder 28 on the side opposite to the drive mechanism housing 30 in the axial direction. The cooling stage 32 is provided so as to transmit coldness generated by the expander 14 to other objects. The objects are attached to the cooling stage 32, and are cooled by the cooling stage 32 during the operation of the cryocooler 10.

During the operation of the cryocooler 10, the regenerator 16 includes a regenerator high-temperature portion 16*a* on one side (upper side in the drawing) in the axial direction, and a regenerator low-temperature portion 16*b* on the side (lower side in the drawing) opposite to the regenerator high-temperature portion 16*a*. In this way, the regenerator 16 has a temperature distribution in the axial direction. Similarly, other components (for example, displacer 24 and cylinder 28) of the expander 14 which surrounds the regenerator 16 also have axial temperature distributions. Accordingly, the expander 14 includes a high-temperature portion on one side in the axial direction and a low-temperature portion on the other side in the axial direction during the operation of the expander 14. For example, the high-temperature portion has a temperature such as an approximately room temperature. The cooling temperatures of the low-temperature portion are different from each other according to the use of the cryocooler 10, and for example, the low-temperature portion is cooled to a temperature which is included in a range from approximately 1 OK to approximately 10 OK. The cooling stage 32 is fixed to the cylinder 28 to enclose the low-temperature portion of the cylinder 28.

In the present specification, for convenience of the description, terms such as an axial direction, a radial direction, and a circumferential direction are used. As shown by an arrow A, the axial direction indicates the movement direction of the expander movable portion 20 with respect to the expander stationary portion 22. The radial direction indicates a direction (horizontal direction in the drawing) perpendicular to the axial direction, and the circumferential direction indicates a direction which surrounds the axial direction. An element of the expander 14 being close to the cooling stage 32 in the axial direction may be referred to "down", and the element being far from the cooling stage 32 in the axial direction may be referred to as "up." Accordingly, the high-temperature portion and the low-temperature portion of the expander 14 are respectively positioned on the upper portion and the lower portion in the axial direction. The expressions are used so as to only assist understanding of a relative positional relationship between elements of the expander 14. Accordingly, the expressions are not related to the disposition of the expander 14 when the expander 14 is installed in site. For example, in the expander 14, the cooling stage 32 may be installed upward and the drive mechanism housing 30 may be installed downward. Alternatively, the expander 14 may be installed such that the axial direction coincides with the horizontal direction.

In addition, terms such as the axial direction, the radial direction, and the circumferential direction are used with respect to the rotary valve mechanism. In this case, the axial direction indicates the direction of the rotation axis of the rotary valve mechanism. The direction of the rotary valve-rotational axis is orthogonal to the axial direction of the expander.

The configuration of the flow path of the working gas in the expander 14 is described. The expander 14 includes a valve component 34, a housing gas flow path 36, an upper gas chamber 37, a displacer upper-lid gas flow path 38, a displacer lower-lid gas flow path 39, a gas expansion chamber 40, and a low-pressure gas chamber 42. A high-pressure gas flows from the first pipe 18*a* to the gas expansion chamber 40 via the valve component 34, the housing gas flow path 36, the upper gas chamber 37, the displacer upper-lid gas flow path 38, the regenerator 16, and the displacer lower-lid gas flow path 39.

The gas returned to the gas expansion chamber 40 flows to the low-pressure gas chamber 42 via the displacer lower-lid gas flow path 39, the regenerator 16, the displacer upper-lid gas flow path 38, the upper gas chamber 37, the housing gas flow path 36, and the valve component 34.

Although it is described below in detail, the valve component 34 is configured to control the pressure of the gas expansion chamber 40 to be synchronized with the reciprocation of the displacer 24. The valve component 34 functions as a portion of a supply path for supplying a high-pressure gas to the gas expansion chamber 40, and function as a portion of a discharging path for discharging a low-pressure gas from the gas expansion chamber 40. The valve component 34 is configured to end the discharging of the low-pressure gas and to start the supply of the high-pressure gas when the displacer 24 passes a bottom dead center or the vicinity thereof. The valve component 34 is configured to end the supply of the high-pressure gas and to start the discharging of the low-pressure gas when the displacer 24 passes a top dead center or the vicinity thereof. In this way, the valve component 34 is configured to switch the supply function and the discharging function of the working gas to be synchronized with the reciprocation of the displacer 24.

The housing gas flow path 36 is formed so as to penetrate the drive mechanism housing 30 such that gas flows between the expander stationary portion 22 and the upper gas chamber 37.

The upper gas chamber 37 is formed between the expander stationary portion 22 and the displacer 24 on the regenerator high-temperature portion 16*a* side. More specifically, the upper gas chamber 37 is interposed between the drive mechanism housing 30 and the displacer 24 in the axial direction, and is surrounded by the cylinder 28 in the circumferential direction.

The upper gas chamber 37 is adjacent to the low-pressure gas chamber 42. The upper gas chamber 37 is also referred to as a room temperature chamber. The upper gas chamber 37 is a variable volume which is formed between the expander movable portion 20 and the expander stationary portion 22.

The displacer upper-lid gas flow path 38 is at least one opening of the displacer member 24*a* which is formed to allow the regenerator high-temperature portion 16*a* to communicate with the upper gas chamber 37. The displacer lower-lid gas flow path 39 is at least one opening of the displacer member 24*a* which is formed to allow the regenerator low-temperature portion 16*b* to communicate with the gas expansion chamber 40.

A seal portion 44 which seals a clearance between the displacer 24 and the cylinder 28 is provided on the side surface of the displacer member 24*a*. The seal portion 44 may be attached to the displacer member 24*a* so as to surround the displacer upper-lid gas flow path 38 in the circumferential direction.

The gas expansion chamber 40 is formed between the cylinder 28 and the displacer 24 on the regenerator low-temperature portion 16*b* side. Similarly to the upper gas chamber 37, the gas expansion chamber 40 is a variable volume which is formed between the expander movable portion 20 and the expander stationary portion 22, and the volume of the gas expansion chamber 40 is complementarily changed with the volume of the upper gas chamber 37 by the relative movement of the displacer 24 with respect to the cylinder 28. Since the seal portion 44 is provided, a direct gas flow (that is, the flow of gas which bypasses the regenerator 16) between the upper gas chamber 37 and the gas expansion chamber 40 is not generated.

The low-pressure gas chamber 42 defines the inside of the drive mechanism housing 30. The second pipe 18*b* is connected to the drive mechanism housing 30. Accordingly, the low-pressure gas chamber 42 communicates with the suction port 12*b* of the compressor 12 through the second pipe 18*b*. Therefore, the low-pressure gas chamber 42 is always maintained to a low pressure.

The displacer drive shaft 26 protrudes from the displacer 24 to the low-pressure gas chamber 42 through the upper gas chamber 37. The expander stationary portion 22 includes a pair of drive shaft guides 46*a* and 46*b* which support the displacer drive shaft 26 in the axial direction in a movable manner. Each of the drive shaft guides 46*a* and 46*b* is provided in the drive mechanism housing 30 so as to surround the displacer drive shaft 26. The drive shaft guide 46*b* positioned on the lower side in the axial direction or the lower end section of the drive mechanism housing 30 is air tightly configured. Accordingly, the low-pressure gas chamber 42 is separated from the upper gas chamber 37. The direct gas flow between the low-pressure gas chamber 42 and the upper gas chamber 37 is not generated.

The expander 14 includes a drive mechanism 48 which drives the displacer 24. The drive mechanism 48 is accommodated in the low-pressure gas chamber 42, and includes a motor 48*a* and a scotch yoke mechanism 48*b*. The displacer drive shaft 26 forms a portion of the scotch yoke mechanism 48*b*. In addition, the scotch yoke mechanism 48*b* includes a crank pin 49 which extends to be parallel to the output shaft of the motor 48*a* and is eccentric to the output shaft. The displacer drive shaft 26 is connected to the scotch yoke mechanism 48*b* to be driven in the axial direction by the scotch yoke mechanism 48*b*. Accordingly, the displacer 24 reciprocates in the axial direction by the rotation of the motor 48*a*. The scotch yoke mechanism 48*b* is interposed between the drive shaft guides 46*a* and 46*b*, and the drive shaft guides 46*a* and 46*b* are positioned at different positions from each other in the axial direction.

The valve component 34 is connected to the drive mechanism 48 and is accommodated in the drive mechanism housing 30. The valve component 34 is a rotary valve type. The valve component 34 includes a rotor valve resin member (hereinafter, may be simply referred to as a valve rotor) 34*a* and a stator valve metal member (hereinafter, may be simply referred to as a valve stator) 34*b*. That is, the valve rotor 34*a* is formed of a resin material (for example, engineering plastic material or fluororesin material), and the valve stator 34*b* is formed of metal (for example, aluminum material or steel material). Conversely, the valve rotor 34*a* may be formed of metal and the valve stator 34*b* is formed of a resin. The valve rotor 34*a* and the valve stator 34*b* may be respectively referred to as a valve disk and a valve body.

The valve rotor 34*a* and the valve stator 34*b* are disposed in the low-pressure gas chamber 42. The valve rotor 34*a* is connected to the output shaft of the motor 48*a* so as to be rotated by the rotation of the motor 48*a*. The valve rotor 34*a* is in surface-contact with the valve stator 34*b* so as to rotationally slide on the valve stator 34*b*. The valve stator 34*b* is fixed to the drive mechanism housing 30. The valve stator 34*b* is configured so as to receive the high-pressure gas which enters the drive mechanism housing 30 from the first pipe 18*a*.

Figure 2:
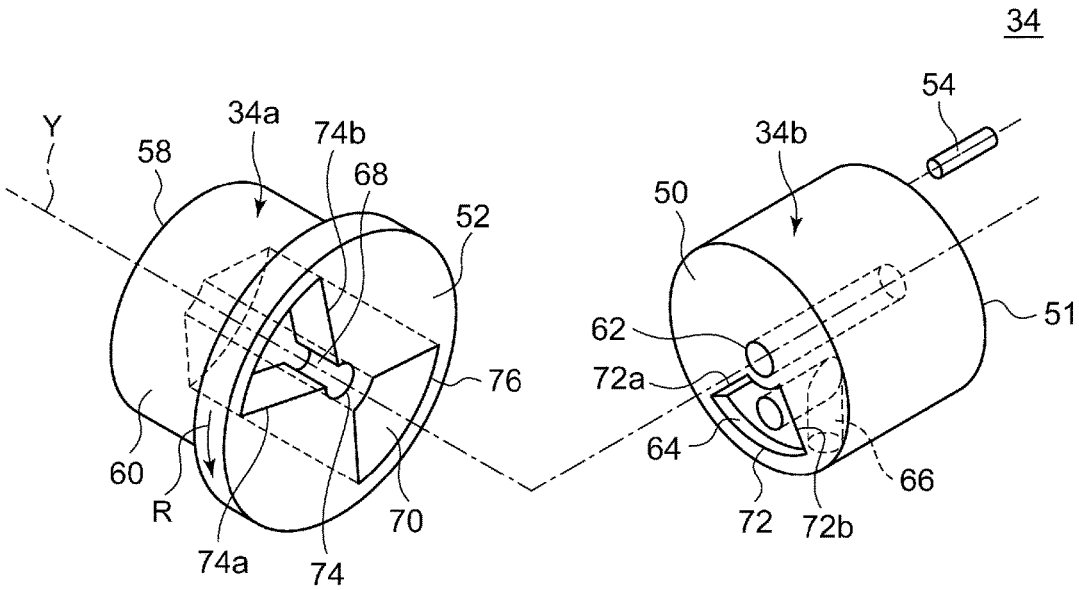
FIG. 2 is an exploded perspective view schematically showing a valve portion according to the embodiment of the present invention.
Figure 3A:
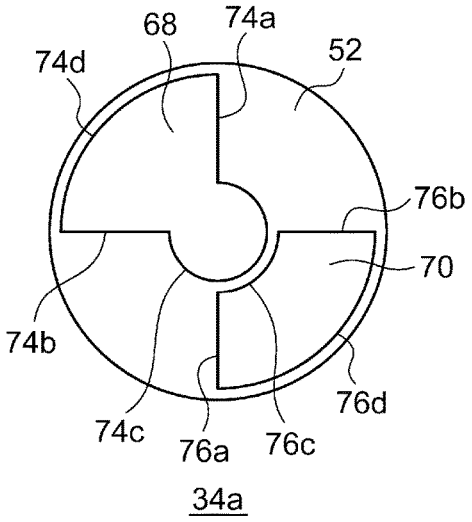
FIGS. 3A and 3B are plan views schematically showing a valve rotor and a valve stator according to the embodiment of the present invention.
Figure 3B:
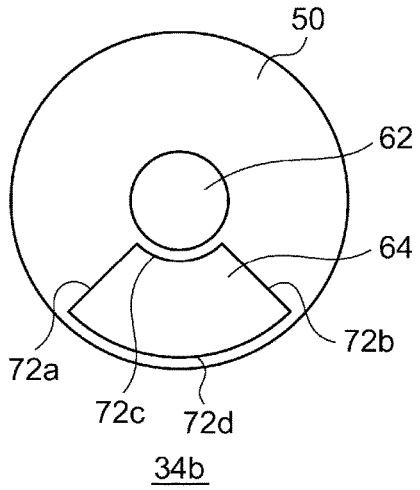

FIG. 2 is an exploded perspective view schematically showing the main portion of the valve component 34 according to the embodiment of the present invention. A dashed line shown in FIG. 2 indicates a valve-rotational axis Y. In addition, FIGS. 3A and 3B are plan views schematically showing the valve rotor 34*a* and the valve stator 34*b* according to the embodiment of the present invention.

The valve stator 34*b* includes a stator plane 50 which is perpendicular to the valve-rotational axis Y, and similarly, the valve rotor 34*a* includes a rotor plane 52 which is perpendicular to the valve-rotational axis Y. When the valve rotor 34*a* rotates with respect to the valve stator 34*b*, the rotor plane 52 rotationally slides on the stator plane 50. Since the stator plane 50 and the rotor plane 52 are in surface-contact with each other, leakage of a refrigerant gas is prevented.

The valve stator 34*b* is fixed to the inside of the drive mechanism housing 30 by a valve stator valve fixing pin 54. The valve stator fixing pin 54 engages with a valve stator end surface 51 which is positioned on the side opposite to the stator plane 50 of the valve stator 34*b* in the rotation axis direction, and regulates the rotation of the valve stator 34*b*.

The valve rotor 34*a* is rotatably supported by a rotor bearing 56 shown in FIG. 1. An engagement hole (not shown) which engages with the crank pin 49 is formed on a valve rotor end surface 58 which is positioned on the rotor plane 52 of the valve rotor 34*a* in the rotation axis direction. The motor 48*a* rotates the crank pin 49, and thereby, the valve rotor 34*a* rotates so as to be synchronized with the scotch yoke mechanism 48*b*. Moreover, the valve rotor 34*a* includes a rotor outer peripheral surface 60 which connects the rotor plane 52 to the valve rotor end surface 58. The rotor outer peripheral surface 60 is supported by the rotor bearing 56 and faces the low-pressure gas chamber 42.

The valve stator 34*b* includes a high-pressure gas inflow port 62 and a stator recessed portion 64. The high-pressure gas inflow port 62 is open to the center portion of the stator plane 50, and is formed to penetrate the center portion of the valve stator 34*b* in the rotation axis direction. The high-pressure gas inflow port 62 defines a cylindrical outline which has the valve-rotational axis Y as a center on the stator plane 50. The high-pressure gas inflow port 62 communicates with the discharging port 12*a* of the compressor 12 through the first pipe 18*a*. The stator recessed portion 64 is open outside the high-pressure gas inflow port 62 in the radial direction on the stator plane 50. The stator recessed portion 64 is formed in a fan shape with the high-pressure gas inflow port 62 as a center. The depth of the stator recessed portion 64 is shorter than the length of the valve stator 34*b* in the rotation axis direction, and the stator recessed portion 64 does not penetrate the valve stator 34*b*.

The valve stator 34*b* includes a communication path 66 which is formed so as to penetrate the valve stator 34*b* to connect the stator recessed portion 64 to the housing gas flow path 36. Accordingly, the stator recessed portion 64 finally communicates with the gas expansion chamber 40 via the communication path 66 and the housing gas flow path 36. One end of the communication path 66 is open to the stator recessed portion 64 and the other end thereof is open to the side surface of the valve stator 34*b*. While the portion of the communication path 66 on the stator recessed portion 64 side extends in the rotation axis direction, the portion of the communication path 66 on the housing gas flow path 36 side extends in the radial direction so as to be orthogonal to the rotation axis direction.

The stator recessed portion 64 defines a fan-shaped stator recessed portion outline 72 on the stator plane 50. The stator recessed portion outline 72 includes a stator-recessed-portion front edge line 72*a*, a stator-recessed-portion rear edge line 72*b*, a stator recessed portion inner edge line 72*c*, and a stator recessed portion outer edge line 72*d*. The stator-recessed-portion front edge line 72*a* and the stator-recessed-portion rear edge line 72*b* are positioned so as to be separated from each other in the valve-rotational direction R, and the stator recessed portion inner edge line 72*c* and the stator recessed portion outer edge line 72*d* are positioned so as to be separated from each other in the valve radial direction. The stator recessed portion inner edge line 72*c* connects one end of the stator-recessed-portion front edge line 72*a* to one end of the stator-recessed-portion rear edge line 72*b*, and the stator recessed portion outer edge line 72*d* connects the other end of the stator-recessed-portion front edge line 72*a* to the other end of the stator-recessed-portion rear edge line 72*b*.

Each of the stator-recessed-portion front edge line 72*a* and the stator-recessed-portion rear edge line 72*b* is linear. The stator-recessed-portion front edge line 72*a* and the stator-recessed-portion rear edge line 72*b* are respectively formed on the stator plane 50 along a first radius and a second radius which have the valve-rotational axis Y as centers. The first radius and the second radius are positioned at angular positions different from each other.

The stator recessed portion inner edge line 72*c* and the stator recessed portion outer edge line 72*d* respectively are arcs which have the valve-rotational axis Y as centers and have the same center angle as each other. The stator recessed portion inner edge line 72*c* is positioned inside the stator recessed portion outer edge line 72*d* in the radial direction. That is, the radius of the stator recessed portion inner edge line 72*c* is smaller than the radius of the stator recessed portion outer edge line 72*d*. In addition, the radius of the stator recessed portion inner edge line 72*c* is larger than the radius of the circular outline of the high-pressure gas inflow port 62.

The valve rotor 34*a* includes a rotor recessed portion 68 and a low-pressure gas outflow port 70. The rotor plane 52 is in surface-contact with the stator plane 50 around the rotor recessed portion 68. Similarly, the rotor plane 52 is in surface-contact with the stator plane 50 around the low-pressure gas outflow port 70.

The rotor recessed portion 68 is open to the rotor plane 52 and is formed in a fan shape. The rotor recessed portion 68 extends from the center portion of the rotor plane 52 toward the outside in the radial direction. The depth of the rotor recessed portion 68 is shorter than the length of the valve rotor 34*a* in the rotation axis direction, and the rotor recessed portion 68 does not penetrate the valve rotor 34*a*. The rotor recessed portion 68 is positioned at the location corresponding to the high-pressure gas inflow port 62 on the rotor plane 52, and the rotor recessed portion 68 communicates with high-pressure gas inflow port 62 at all times.

The rotor recessed portion 68 defines a rotor recessed portion outline 74 on the rotor plane 52. The rotor recessed portion outline 74 includes a rotor-recessed-portion front edge line 74*a*, a rotor-recessed-portion rear edge line 74*b*, a rotor recessed portion inner edge line 74*c*, and a rotor recessed portion outer edge line 74*d*. The rotor-recessed-portion front edge line 74*a* and the rotor-recessed-portion rear edge line 74*b* are positioned so as to be separated from each other in the valve-rotational direction R, and the rotor recessed portion inner edge line 74*c* and the rotor recessed portion outer edge line 74*d* are positioned so as to be separated from each other in the valve radial direction. The rotor recessed portion inner edge line 74*c* connects one end of the rotor-recessed-portion front edge line 74*a* to one end of the rotor-recessed-portion rear edge line 74*b*, and the rotor recessed portion outer edge line 74*d* connects the other end of the rotor-recessed-portion front edge line 74*a* to the other end of the rotor-recessed-portion rear edge line 74*b*.

Each of the rotor-recessed-portion front edge line 74*a* and the rotor-recessed-portion rear edge line 74*b* is linear. The rotor-recessed-portion front edge line 74*a* and the rotor-recessed-portion rear edge line 74*b* are respectively formed on the rotor plane 52 along a first radius and a second radius which have the valve-rotational axis Y as centers. The first radius and the second radius are positioned at angular positions different from each other.

Each of the rotor recessed portion inner edge line 74*c* and the rotor recessed portion outer edge line 74*d* is an arc which has the valve-rotational axis Y as a center. The center angle of the rotor recessed portion inner edge line 74*c* is positioned on a side opposite to the center angle of the rotor recessed portion outer edge line 74*d* with respect to the valve-rotational axis Y. The rotor recessed portion inner edge line 74*c* is positioned inside the rotor recessed portion outer edge line 74*d* in the radial direction, and the radius of the rotor recessed portion inner edge line 74*c* is smaller than the radius of the stator recessed portion outer edge line 72*d*. The radius of the rotor recessed portion inner edge line 74*c* is the same as the radius of the circular outline of the high-pressure gas inflow port 62, and the radius of the rotor recessed portion outer edge line 74*d* is the same as the radius of the stator recessed portion outer edge line 72*d*.

The rotor recessed portion 68 is formed in the valve rotor 34*a* so as to allow the high-pressure gas inflow port 62 to communicate with the stator recessed portion 64 in a portion (for example, an intake process) of one period of the rotation of the valve rotor 34*a*, and allow the high-pressure gas inflow port 62 not to communicate with the stator recessed portion 64 in a remaining portion (for example, exhaust process) of the one period. Two regions configured of the rotor recessed portion 68 and the high-pressure gas inflow port 62, or three regions configured of the rotor recessed portion 68, the high-pressure gas inflow port 62, and the stator recessed portion 64 form high-pressure regions (or high-pressure flow paths) which communicates with each other in the valve component 34. The valve rotor 34*a* seals the high-pressure region and is disposed to be adjacent to the valve stator 34*b* so as to separate the high-pressure region from the low-pressure surrounding environment (that is, low-pressure gas chamber 42). The rotor recessed portion 68 is provided as a flow direction changing portion or a flow path folding portion in the high-pressure flow path of the valve component 34. In this way, an intake valve V1 (refer to FIG. 4) which defines an intake process A1 is configured in the valve component 34.

The low-pressure gas outflow port 70 is open to the rotor plane 52 on the side opposite to the rotor recessed portion 68 in the radial direction, and is formed so as to penetrate the valve rotor 34*a* in the rotation axis direction. The low-pressure gas outflow port 70 penetrates from the rotor plane 52 of the valve rotor 34*a* to the valve rotor end surface 58. The low-pressure gas outflow port 70 forms a low-pressure flow path which communicates with the low-pressure gas chamber 42.

The low-pressure gas outflow port 70 defines a fan-shaped outflow port outline 76 on the rotor plane 52. The outflow port outline 76 includes an outflow-port front edge line 76*a*, an outflow-port rear edge line 76*b*, an outflow port inner edge line 76*c*, and an outflow port outer edge line 76*d*. The outflow-port front edge line 76*a* and the outflow-port rear edge line 76*b* are positioned so as to be separated from each other in a valve-rotational direction R, and the outflow port inner edge line 76*c* and the outflow port outer edge line 76*d* are positioned so as to be separated from each other in the valve radial direction. The outflow port inner edge line 76*c* connects one end of the outflow-port front edge line 76*a* to one end of the outflow-port rear edge line 76*b*, and the outflow port outer edge line 76*d* connects the other end of the outflow-port front edge line 76*a* to the outer end of the outflow-port rear edge line 76*b*. The outflow port outline 76 has approximately the same shape as that of the stator recessed portion outline 72.

Each of the outflow-port front edge line 76*a* and the outflow-port rear edge line 76*b* is linear. The outflow-port front edge line 76*a* and the outflow-port rear edge line 76*b* are respectively formed on the stator plane 50 along a third radius and a fourth radius which have the valve-rotational axis Y as centers. The third radius and the fourth radius are respectively positioned on sides approximately opposite to the first radius and the second radius. Accordingly, the outflow-port front edge line 76*a* is separated from the rotor-recessed-portion front edge line 74*a* by approximately 180°, and the outflow-port rear edge line 76*b* is separated from the rotor-recessed-portion rear edge line 74*b* by approximately 180°.

The outflow port inner edge line 76*c* and the outflow port outer edge line 76*d* respectively are arcs which have the valve-rotational axis Y as centers and have the same center angle as each other. The outflow port inner edge line 76*c* is positioned inside the outflow outer edge line 76*d* in the radial direction. That is, the radius of the outflow port inner edge line 76*c* is smaller than the radius of the outflow port outer edge line 76*d*. The radius of the outflow port inner edge line 76*c* is the same as the radius of the stator recessed portion inner edge line 72*c*, and the radius of the outflow port outer edge line 76*d* is the same as the radius of the stator recessed portion outer edge line 72*d*.

The low-pressure gas outflow port 70 is formed in the valve rotor 34*a* so as to allow the stator recessed portion 64 to communicate with the low-pressure gas chamber 42 in at least a portion (for example, exhaust process) of the period in which the high-pressure gas inflow port 62 does not communicate with the stator recessed portion 64. Accordingly, an exhaust valve V2 (refer to FIG. 4) which defines an exhaust process A2 is formed in the valve component 34.

Figure 4:
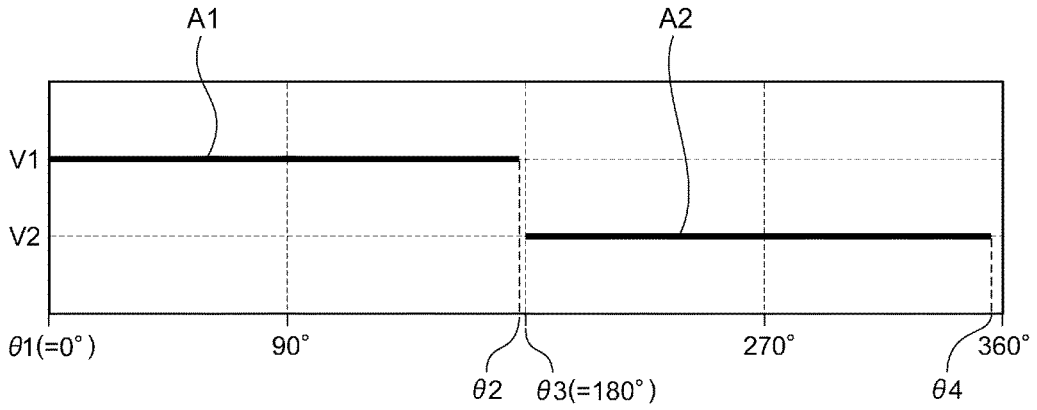
FIG. 4 is a view showing an operation of the cryocooler according to the embodiment of the present invention.

The operation of the cryocooler 10 having the above-described configuration will be described. FIG. 4 is a view showing the operation of the cryocooler 10 according to the embodiment of the present invention. FIGS. 5A to 5D are views showing the operation of the valve component 34 according to the embodiment of the present invention.

The intake process A1 and the exhaust process A2 of the cryocooler 10 are shown in FIG. 4. In FIG. 4, one period (one period in the axial reciprocation of the displacer 24) of the rotation of the valve component 34 is shown so as to correspond to 360°. 0° corresponds to a starting time point of the period and 360° corresponds to an end time point of the period. 90°, 180°, and 270° are ¼ period, a half period, and ¾ period, respectively.

The intake process A1 is a range from first phase θ1 of the valve rotation to a second phase θ2 and the exhaust process A2 is a range from a third phase θ3 of the valve rotation to a fourth phase θ4. The intake process A1 and the exhaust process A2 alternate with each other. The intake process A1 ends immediately before the exhaust process A2 starts and the exhaust process A2 ends immediately before the intake process A1 starts such that the intake process A1 and the exhaust process A2 do not overlap each other. The displacer 24 is positioned at the bottom dead center or in the vicinity thereof at the first phase θ1, and is positioned at the top dead center or in the vicinity thereof at the third phase θ3.

In FIG. 4, the first phase θ1 is approximately 0° and the second phase θ2 is approximately 180°. The third phase θ3 is approximately 180° and the fourth phase θ4 is approximately 360°. However, the first phase θ1, the second phase θ2, the third phase θ3, and the fourth phase θ4 are not limited to this.

When the displacer 24 moves to the bottom dead center of the cylinder 28 or the vicinity thereof, the valve component 34 is switched so as to connect the discharging port 12*a* of the compressor 12 to the gas expansion chamber 40. The intake process A1 of the cryocooler 10 starts. The high-pressure gas enters the regenerator high-temperature portion 16*a* through the housing gas flow path 36, the upper gas chamber 37, and the displacer upper-lid gas flow path 38 from the valve component 34. The gas is cooled while passing through the regenerator 16 and enters the gas expansion chamber 40 through the displacer lower-lid gas flow path 39 from the regenerator low-temperature portion 16*b*. While the gas flows into the gas expansion chamber 40, the displacer 24 moves toward the top dead center of the cylinder 28. Accordingly, the volume of the gas expansion chamber 40 increases. Therefore, the gas expansion chamber 40 is filled with the high-pressure gas.

When the displacer 24 moves to the top dead center of the cylinder 28 or the vicinity thereof, the valve component 34 is switched so as to connect the suction port 12*b* of the compressor 12 to the gas expansion chamber 40. The intake process A1 ends and the exhaust process A2 starts. The high-pressure gas is expanded and cooled in the gas expansion chamber 40. The expanded gas enters the regenerator 16 through the displacer lower-lid gas flow path 39 from the gas expansion chamber 40. The gas is cooled while passing through the regenerator 16. The gas is returned to the compressor 12 via the housing gas flow path 36, the valve component 34, and the low-pressure gas chamber 42 from the regenerator 16. While the gas flows out from the gas expansion chamber 40, the displacer 24 moves toward the bottom dead center of the cylinder 28. Accordingly, the volume of the gas expansion chamber 40 is decreased, and a low-pressure gas is discharged from the gas expansion chamber 40. If the exhaust process A2 ends, the intake process A1 starts again.

FIGS. 5A, 5B, 5C, and 5D respectively show relative positions between the valve rotor 34*a* and the valve stator 34*b* at the first phase θ1, the second phase θ2, the third phase θ3, and the fourth phase θ4. The valve rotor 34*a* rotates in the valve-rotational direction R (the counterclockwise direction in the drawings) with respect to the valve stator 34*b*. The high-pressure gas inflow port 62 and the stator recessed portion 64 of the valve stator 34*b* are shown by solid lines, and the rotor recessed portion 68 and the low-pressure gas outflow port 70 of the valve rotor 34*a* are shown by broken lines.

Figure 5A:
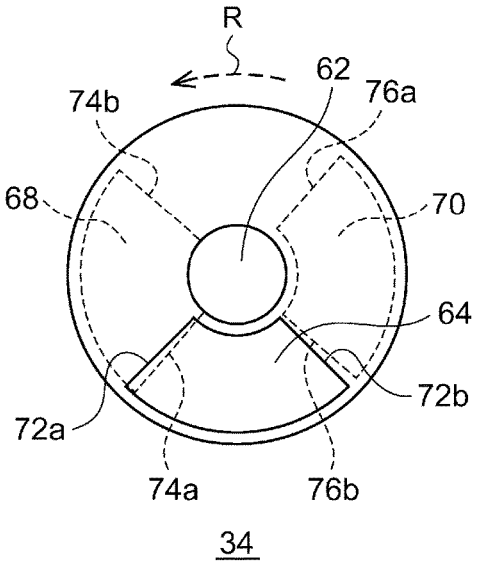
FIGS. 5A to 5D are views showing an operation of the valve portion according to the embodiment of the present invention.

At the first phase θ1, the rotor-recessed-portion front edge line 74*a* passes through the stator-recessed-portion front edge line 72*a* and the rotor recessed portion 68 fluidally communicates with the stator recessed portion 64. FIG. 5A shows an aspect immediately after the passage. The shape of the rotor-recessed-portion front edge line 74*a* coincides with the shape of the stator-recessed-portion front edge line 72*a*, and the rotor-recessed-portion front edge line 74*a* overlaps the stator-recessed-portion front edge line 72*a* at the first phase θ1. In the way, at the first phase θ1, the intake valve V1 is open and the intake process A1 starts. During the intake process A1, the low-pressure gas outflow port 70 is fluidally separated from the stator recessed portion 64.

Figure 5B:
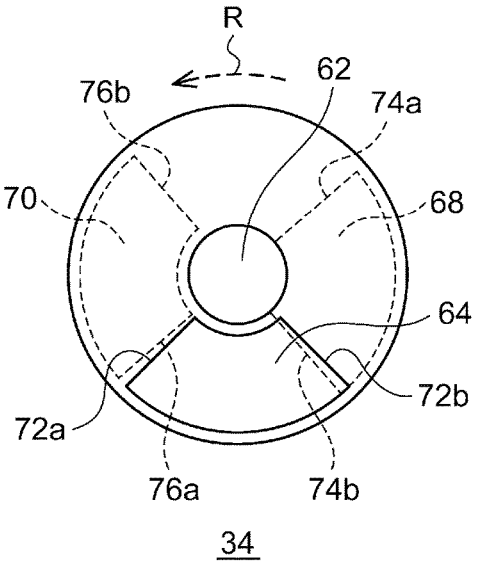

At the second phase θ2, the rotor-recessed-portion rear edge line 74*b* passes through the stator-recessed-portion rear edge line 72*b* and the rotor recessed portion 68 is fluidally from the stator recessed portion 64. FIG. 5B shows an aspect immediately before the passage. The shape of the rotor-recessed-portion rear edge line 74*b* coincides with the shape of the stator-recessed-portion rear edge line 72*b*, and the rotor-recessed-portion rear edge line 74*b* overlaps the stator-recessed-portion rear edge line 72*b* at the second phase θ2. In the way, at the second phase θ2, the intake valve V1 is closed and the intake process A1 ends.

Figure 5C:
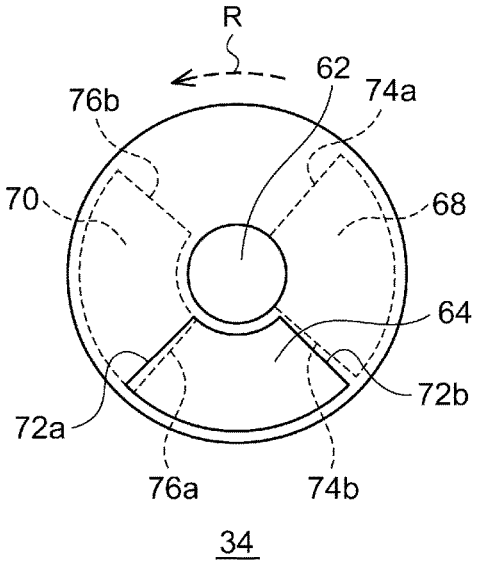

At the third phase θ3, the outflow-port front edge line 76*a* passes through the stator-recessed-portion front edge line 72*a* and the low-pressure gas outflow port 70 fluidally communicates with the stator recessed portion 64. FIG. 5C shows an aspect immediately after the passage. The shape of the outflow-port front edge line 76*a* coincides with the shape of the stator-recessed-portion front edge line 72*a*, and the outflow-port front edge line 76*a* overlaps the stator-recessed-portion front edge line 72*a* at the third phase θ3. In the way, at the third phase θ3, the exhaust valve V2 is open and the exhaust process A2 starts. During the exhaust process A2, the rotor recessed portion 68 is fluidally separated from the stator recessed portion 64.

Figure 5D:
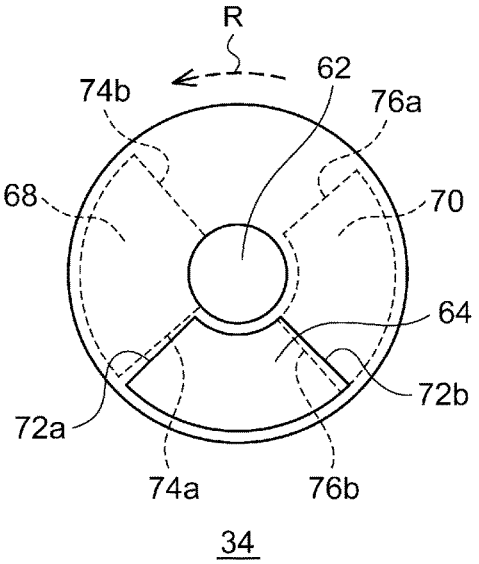

At the fourth phase θ4, the outflow-port rear edge line 76*b* passes through the stator-recessed-portion rear edge line 72*b* and the low-pressure gas outflow port 70 is fluidally from the stator recessed portion 64. FIG. 5D shows an aspect immediately before the passage. The shape of the outflow-port rear edge line 76*b* coincides with the shape of the stator-recessed-portion rear edge line 72*b*, and the outflow-port rear edge line 76*b* overlaps the stator-recessed-portion rear edge line 72*b* at the fourth phase θ4. In the way, at the fourth phase θ4, the exhaust valve V2 is closed and the exhaust process A2 ends.

In this way, in the intake process A1, a high-pressure gas flows from the high-pressure gas inflow port 62 to the stator recessed portion 64 through the rotor recessed portion 68. Finally, the high-pressure gas flows into the gas expansion chamber 40. Meanwhile, in the exhaust process A2, a low-pressure returned gas from the gas expansion chamber 40 flows from the stator recessed portion 64 to the low-pressure gas chamber 42 through the low-pressure gas outflow port 70.

The above-described process is one-time cooling cycle in the cryocooler 10. The cryocooler 10 repeats the cooling cycle and cools the cooling stage 32 to a desired temperature. Accordingly, the cryocooler 10 can cool an object which is thermally connected to the cooling stage 32 to a cryogenic temperature.

Figure 6:
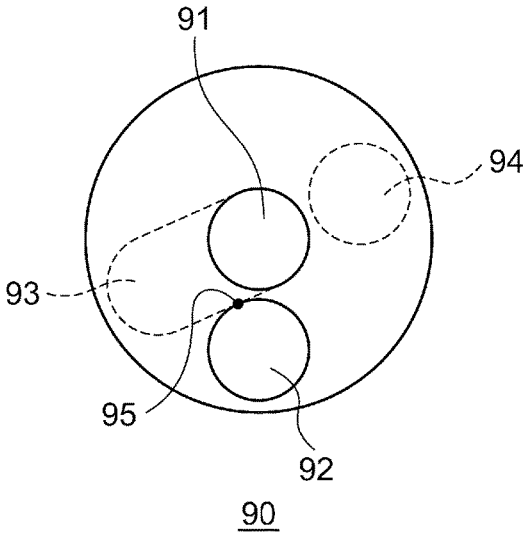
FIG. 6 is a view schematically showing a rotary valve.

FIG. 6 schematically shows a rotary valve 90. The rotary valve 90 includes a first stator circular hole 91, a second stator circular hole 92, a rotor elliptical hole 93, and a rotor circular hole 94. FIG. 6 shows a starting time point of an intake process. As shown in FIG. 6, the rotor elliptical hole 93 is connected to the second stator circular hole 92 by one contact point 95.

In this way, in a case where a rotation flow path and a stationary flow path of the rotary valve 90 overlap each other at one point, a flow path cross-sectional area of the overlapped portion is significantly small. Accordingly, a pressure loss in a flow of a working gas in the overlapped portion increases. The increase in the pressure loss decreases cooling efficiency of the cryocooler.

Meanwhile, the valve component 34 is configured such that the flow path of the valve rotor 34*a* and the flow path of the valve stator 34*b* linearly overlap each other when the valve is open and closed. Accordingly, it is possible to increase the flow path cross-sectional area of the overlapped portion. Therefore, a pressure loss in a flow of a working gas is reduced, and it is possible to improve cooling efficiency of the cryocooler 10.

Since a pressure difference is large when opening of the valve starts, reduction effects of the pressure loss due to the increase of the flow path cross-sectional area increase. Accordingly, preferably, the valve component 34 is configured such that the rotor recessed portion 68 and the stator recessed portion 64 linearly overlap each other when at least the intake process A1 starts. Moreover, the valve component 34 is configured such that the low-pressure gas outflow port 70 and the stator recessed portion 64 may linearly overlap each other when at least the exhaust process A2 starts.

Figure 7A:
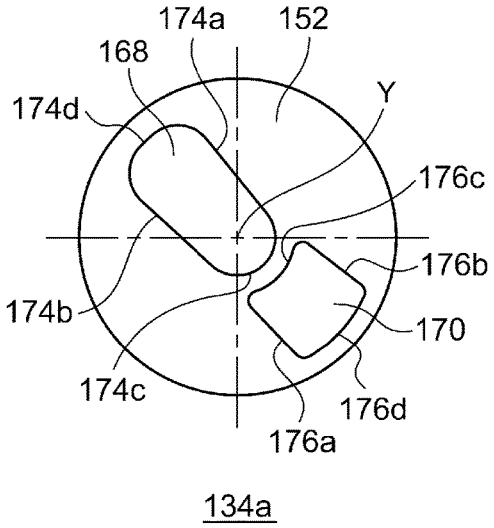
FIGS. 7A and 7B are plan views schematically showing a valve rotor and a valve stator according to another embodiment of the present invention.
Figure 7B:
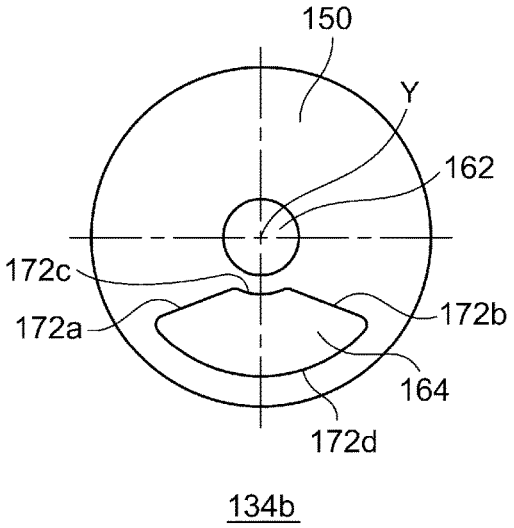

FIGS. 7A and 7B are plan views schematically showing a valve rotor 134*a* and a valve stator 134*b* according to another embodiment of the present invention. FIGS. 8A to 8D are views showing an operation of a valve portion 134 according to another embodiment of the present invention.

Shapes of flow path holes which are different from those of the embodiment described with reference to FIGS. 1 to 5D will be described below. Similarly to the above-described embodiment, an intake valve and an exhaust valve are configured in the valve portion 134.

The valve stator 134*b* includes a high-pressure inflow gas port 162 and a stator recessed portion 164. The high-pressure gas inflow port 162 defines a circular outline, which has the valve-rotational axis Y as a center, on a stator plane 150. The stator recessed portion 164 is open in a fan shape toward the outside in the radial direction with respect to the high-pressure gas inflow port 162 on the stator plane 150.

The stator recessed portion 164 includes a stator-recessed-portion front edge line 172*a*, a stator-recessed-portion rear edge line 172*b*, a stator recessed portion inner edge line 172*c*, and a stator recessed portion outer edge line 172*d* on the stator plane 150. The stator-recessed-portion front edge line 172*a* and the stator-recessed-portion rear edge line 172*b* are positioned so as to be separated from each other in the valve-rotational direction R, and the stator recessed portion inner edge line 172*c* and the stator recessed portion outer edge line 172*d* are positioned so as to be separated from each other in the valve radial direction. The stator recessed portion inner edge line 172*c* connects one end of the stator-recessed-portion front edge line 172*a* to one end of the stator-recessed-portion rear edge line 172*b*, and the stator recessed portion outer edge line 172*d* connects the other end of the stator-recessed-portion front edge line 172*a* to the other end of the stator-recessed-portion rear edge line 172*b*.

Each of the stator-recessed-portion front edge line 172*a* and the stator-recessed-portion rear edge line 172*b* is linear. The stator-recessed-portion front edge line 172*a* and the stator-recessed-portion rear edge line 172*b* are respectively formed on the stator plane 150 in a direction intersecting a first radius and a second radius which have the valve-rotational axis Y as centers. The first radius and the second radius are positioned at angular positions different from each other.

The stator recessed portion inner edge line 172*c* and the stator recessed portion outer edge line 172*d* are arcs which have the valve-rotational axis Y as centers, respectively. The center angle of the stator recessed portion outer edge line 172*d* is larger than the center angle of the stator recessed portion inner edge line 172*c*. The stator recessed portion inner edge line 172*c* is positioned inside the stator recessed portion outer edge line 172*d* in the radial direction, and the radius of the stator recessed portion inner edge line 172*c* is smaller than the radius of the stator recessed portion outer edge line 172*d*. In addition, the radius of the stator recessed portion inner edge line 172*c* is larger than the radius of the circular outline of the high-pressure gas inflow port 162.

The valve rotor 134*a* includes a rotor recessed portion 168 and a low-pressure gas outflow port 170. A rotor plane 152 is in surface-contact with the stator plane 150 around the rotor recessed portion 168. Similarly, the rotor plane 152 is in surface-contact with the stator plane 150 around the low-pressure gas outflow port 170.

The rotor recessed portion 168 is open to the rotor plane 152 and is formed in an elliptical shape. The rotor recessed portion 168 extends from the center portion of the rotor plane 152 toward the outside in the radial direction. The rotor recessed portion 168 is positioned at the location corresponding to the high-pressure gas inflow port 162 on the rotor plane 152, and the rotor recessed portion 168 communicates with high-pressure gas inflow port 162 at all times.

The rotor recessed portion 168 includes a rotor-recessed-portion front edge line 174*a*, a rotor-recessed-portion rear edge line 174*b*, a rotor recessed portion inner edge line 174*c*, and a rotor recessed portion outer edge line 174*d* on the rotor plane 152. The rotor-recessed-portion front edge line 174*a* and the rotor-recessed-portion rear edge line 174*b* are positioned so as to be separated from each other in the valve-rotational direction R, and the rotor recessed portion inner edge line 174*c* and the rotor recessed portion outer edge line 174*d* are positioned so as to be separated from each other in the valve radial direction. The rotor recessed portion inner edge line 174*c* connects one end of the rotor-recessed-portion front edge line 174*a* to one end of the rotor-recessed-portion rear edge line 174*b*, and the rotor recessed portion outer edge line 174*d* connects the other end of the rotor-recessed-portion front edge line 174*a* to the other end of the rotor-recessed-portion rear edge line 174*b*. The rotor recessed portion 168 is formed such that the width gradually increases from the center portion toward the outside in the radial direction.

Each of the rotor-recessed-portion front edge line 174*a* and the rotor-recessed-portion rear edge line 174*b* is linear. The rotor-recessed-portion front edge line 174*a* and the rotor-recessed-portion rear edge line 174*b* extend from the center portion of the rotor plane 152 to the outside in the radial direction, and a gap between the rotor-recessed-portion front edge line 174*a* and the rotor-recessed-portion rear edge line 174*b* gradually increases from the center portion toward the outside in the radial direction. The rotor recessed portion inner edge line 174*c* is a semicircular, and the radius of the rotor recessed portion inner edge line 174*c* is the same as the radius of the circular outline of the high-pressure gas inflow port 162. The rotor recessed portion outer edge line 174*d* is bent along the stator recessed portion outer edge line 172*d* at the same radial position as that of the stator recessed portion outer edge line 172*d*.

The low-pressure gas outflow port 170 includes an outflow-port front edge line 176*a*, an outflow-port rear edge line 176*b*, an outflow port inner edge line 176*c*, and an outflow port outer edge line 176*d* on the rotor plane 152. The outflow-port front edge line 176*a* and the outflow-port rear edge line 176*b* are positioned so as to be separated from each other in the valve-rotational direction R, and the outflow port inner edge line 176*c* and the outflow port outer edge line 176*d* are positioned so as to be separated from each other in the valve radial direction. The outflow port inner edge line 176*c* connects one end of the outflow-port front edge line 176*a* to one end of the outflow-port rear edge line 176*b*, and the outflow port outer edge line 176*d* connects the other end of the outflow-port front edge line 176*a* to the other end of the outflow-port rear edge line 176*b*.

Each of the outflow-port front edge line 176*a* and the outflow-port rear edge line 176*b* is linear.

The outflow-port front edge line 176*a* and the outflow-port rear edge line 176*b* are respectively formed on the stator plane 150 in a direction intersecting a third radius and a fourth radius which have the valve-rotational axis Y as centers. The third radius and the fourth radius are respectively positioned on sides approximately opposite to the first radius and the second radius with respect to the valve-rotational axis Y.

The outflow port inner edge line 176*c* and the outflow port outer edge line 176*d* are arcs which have the valve-rotational axis Y as centers, respectively. The center angle of the outflow port inner edge line 176*c* is larger than the center angle of the outflow port outer edge line 176*d*. The outflow port inner edge line 176*c* is positioned inside the outflow port outer edge line 176*d* in the radial direction, and the radius of the outflow port inner edge line 176*c* is smaller than the radius of the outflow port outer edge line 176*d*. In addition, the radius of outflow port inner edge line 176*c* is the same as the radius of the stator recessed portion inner edge line 172*c*, and the radius of the outflow port outer edge line 176*d* is the same as the radius of the stator recessed portion outer edge line 172*d*.

FIGS. 8A, 8B, 8C, and 8D respectively show relative positions between the valve rotor 134*a* and the valve stator 134*b* at a first phase, a second phase, a third phase, and a fourth phase. The valve rotor 134*a* rotates in the valve-rotational direction R (the counterclockwise direction in the drawings) with respect to the valve stator 134*b*. The valve stator 134*b* is shown by a solid line, and the valve rotor 134*a* is shown by a broken line.

Figure 8A:
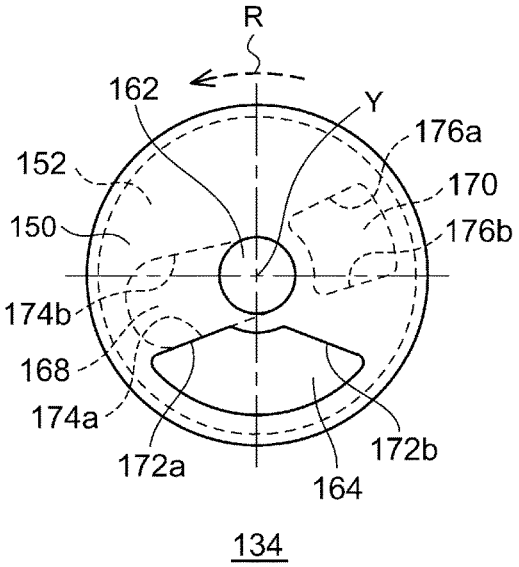
FIGS. 8A to 8D are views showing an operation of a valve portion according to another embodiment of the present invention.

As shown in FIG. 8A, at the first phase, the rotor-recessed-portion front edge line 174*a* passes through the stator-recessed-portion front edge line 172*a* and the rotor recessed portion 168 fluidally communicates with the stator recessed portion 164. The shape of the rotor-recessed-portion front edge line 174*a* coincides with the shape of the stator-recessed-portion front edge line 172*a*, and the rotor-recessed-portion front edge line 174*a* overlaps the stator-recessed-portion front edge line 172*a* at the first phase. In the way, at the first phase, the intake valve is open and the intake process starts. During the intake process, the low-pressure gas outflow port 170 is fluidally separated from the stator recessed portion 164.

Figure 8B:
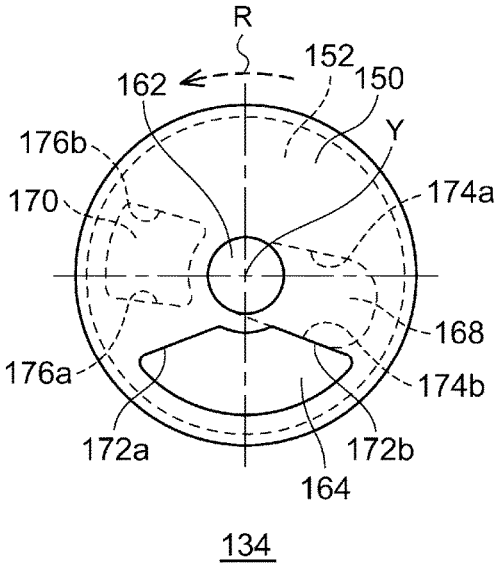

As shown in FIG. 8B, at the second phase, the rotor-recessed-portion rear edge line 174*b* passes through the stator-recessed-portion rear edge line 172*b* and the rotor recessed portion 168 is fluidally from the stator recessed portion 164. The shape of the rotor-recessed-portion rear edge line 174*b* coincides with the shape of the stator-recessed-portion rear edge line 172*b*, and the rotor-recessed-portion rear edge line 174*b* overlaps the stator-recessed-portion rear edge line 172*b* at the second phase. In the way, at the second phase, the intake valve is closed and the intake process ends.

Figure 8C:
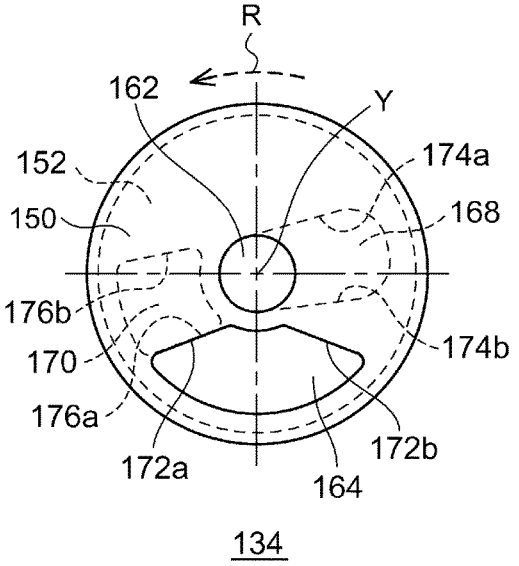

As shown in FIG. 8C, at the third phase, the outflow-port front edge line 176*a* passes through the stator-recessed-portion front edge line 172*a* and the low-pressure gas outflow port 170 fluidally communicates with the stator recessed portion 164. The shape of the outflow-port front edge line 176*a* coincides with the shape of the stator-recessed-portion front edge line 172*a*, and the outflow-port front edge line 176*a* overlaps the stator-recessed-portion front edge line 172*a* at the third phase. In the way, at the third phase, the exhaust valve is open and the exhaust process starts. During the exhaust process, the rotor recessed portion 168 is fluidally separated from the stator recessed portion 164.

Figure 8D:
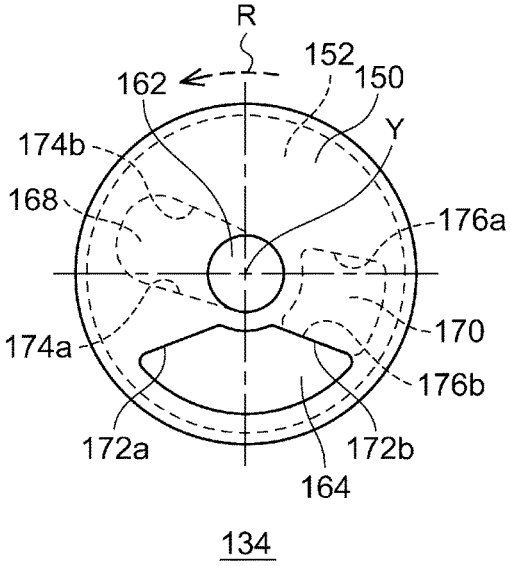

As shown in FIG. 8D, at the fourth phase, the outflow-port rear edge line 176*b* passes through the stator-recessed-portion rear edge line 172*b* and the low-pressure gas outflow port 170 is fluidally from the stator recessed portion 164. The shape of the outflow-port rear edge line 176*b* coincides with the shape of the stator-recessed-portion rear edge line 172*b*, and the outflow-port rear edge line 176*b* overlaps the stator-recessed-portion rear edge line 172*b* at the fourth phase. In the way, at the fourth phase, the exhaust valve is closed and the exhaust process ends.

In this way, in the intake process, a high-pressure gas flows from the high-pressure gas inflow port 162 to the stator recessed portion 164 through the rotor recessed portion 168. Finally, the high-pressure gas flows into the gas expansion chamber 40. Meanwhile, in the exhaust process, a low-pressure returned gas from the gas expansion chamber 40 flows from the stator recessed portion 164 to the low-pressure gas chamber 42 through the low-pressure gas outflow port 170.

The valve portion 134 is configured such that the flow path of the valve rotor 134*a* and the flow path of the valve stator 134*b* linearly overlap each other when the valve is open and closed. Accordingly, since it is possible to increase the flow path cross-sectional area of the overlapped portion, a pressure loss in a flow of a working gas is reduced, and it is possible to improve cooling efficiency of the cryocooler 10.

Hereinbefore, the embodiments of the present invention are described. It should be understood that the invention is not limited to the above-described embodiments, but may be modified into various forms on the basis of the spirit of the invention. Additionally, the modifications are included in the scope of the invention.

In the above-described embodiment, the valve portions 34 and 134 are configured such that the flow paths of the valve rotors 34*a* and 134*a* and the flow paths of the valve stators 34*b* and 134*b* linearly overlap each other when the valves are open and closed. However, in an embodiment, the valve portions may be configured such that the flow path of the valve rotor and the flow path of the valve stator curvedly overlap each other when the valve is open and closed. For example, the curve may be an arc-shaped curve.

Each of the rotor-recessed-portion front edge line and the stator-recessed-portion front edge line may be a curve, and at the first phase, the shape of the rotor-recessed-portion front edge line may coincide with the shape of the stator-recessed-portion front edge line such that the rotor-recessed-portion front edge line overlaps the stator-recessed-portion front edge line. Each of the rotor-recessed-portion rear edge line and the stator-recessed-portion rear edge line may be a curve, and at the second phase, the shape of the rotor-recessed-portion rear edge line may coincide with the shape of the stator-recessed-portion rear edge line such that the rotor-recessed-portion rear edge line overlaps the stator-recessed-portion rear edge line.

Each of the outflow-port front edge line and the stator-recessed-portion front edge line may be a curve, and at the third phase, the shape of the outflow-port front edge line may coincide with the shape of the stator-recessed-portion front edge line such that the outflow-port front edge line overlaps the stator-recessed-portion front edge line. Each of the outflow-port rear edge line and the stator-recessed-portion rear edge line may be a curve, and at the fourth phase, the shape of the outflow-port rear edge line may coincide with the shape of the stator-recessed-portion rear edge line such that the outflow-port rear edge line overlaps the stator-recessed-portion rear edge line.

In addition, the configuration of the flow path in the valve portion may be variously changed. In the above-described embodiments, the rotor recessed portion 68 does not penetrate the valve rotor 34*a* and has a bottom surface in the valve rotor 34*a*. However, instead of this, the rotor recessed portion may be a through hole which penetrates the valve rotor. Similarly, the stator recessed portion may be a through hole which penetrates the valve stator. The high-pressure gas inflow port does not penetrate the valve stator and may have a bottom surface in the valve stator. The low-pressure gas outflow port does not penetrate the valve rotor and may have a bottom surface in the valve rotor. The high-pressure gas inflow port may be formed in the valve rotor. The low-pressure gas outflow port may be formed in the valve stator.

In the above-described embodiments, the embodiments are described in which the cryocooler is a single-stage GM cryocooler. However, the present invention is not limited to this, and the valve configurations according to the embodiments can be applied to a two-stage or a multiple-stage GM cryocooler, or can be applied to other cryocoolers such as a pulse tube cryocooler.

What is claimed is:

1. A cryocooler, comprising:

a compressor for a working gas, the compressor including a compressor discharging port and a compressor suction port;

an expander including a gas expansion chamber, the gas expansion chamber defining an axial orientation of the expander, and a low-pressure gas chamber communicating with the compressor suction port; and a rotary valve component, the rotary valve component defining a valve-rotational direction about a valve-rotational axis and the valve-rotational axis being orthogonal to the axial orientation of the expander, the rotary valve component being composed of a valve stator provided with a stator planar surface perpendicular to the valve-rotational axis, a high-pressure gas inflow port opening onto the stator planar surface and communicating with the compressor discharging port, and in the stator planar surface, a stator recessed portion communicating with the gas expansion chamber, and defining a stator-recessed-portion front edge line and a stator-recessed-portion rear edge line located apart from each other in the valve-rotational direction, the valve stator being arranged in the low-pressure gas chamber, and a valve rotor provided with a rotor planar surface perpendicular to the valve-rotational axis and in surface-contact with the stator planar surface, and in the rotor planar surface, a rotor recessed portion communicating with the high-pressure gas inflow port, and defining a rotor-recessed-portion front edge line and a rotor-recessed-portion rear edge line located apart from each other in the valve-rotational direction, the valve rotor being disposed in the low-pressure gas chamber such as to rotate with respect to the valve stator, about the valve rotational axis; wherein the rotor recessed portion is formed in the valve rotor such that the rotor-recessed-portion front edge line passes through the stator-recessed-portion front edge line and the rotor recessed portion fluidally communicates with the stator recessed portion at a first phase of rotary-valve-component rotation, and such that the rotor-recessed-portion rear edge line passes through the stator-recessed-portion rear edge line and the rotor recessed portion is fluidally separated from the stator recessed portion at a second phase of the rotary-valve-component rotation, and the rotor recessed portion is shaped such that at the first phase of the rotary-valve-component rotation the rotor-recessed-portion front edge line overlappingly coincides with the stator-recessed-portion front edge line.

2. The cryocooler according to claim 1, wherein the rotor-recessed-portion front edge line and the stator-recessed-portion front edge line are each rectilinear.

3. The cryocooler according to claim 1, wherein a shape of the rotor-recessed-portion rear edge line coincides with a shape of the stator-recessed-portion rear edge line such that the rotor-recessed-portion rear edge line overlaps the stator-recessed-portion rear edge line at the second phase.

4. The cryocooler according to claim 3, wherein the rotor-recessed-portion rear edge line and the stator-recessed-portion rear edge line are each rectilinear.

5. The cryocooler according to claim 1, wherein:

the valve rotor includes a low-pressure gas outflow port which defines an outflow-port front edge line and an outflow-port rear edge line positioned such as to be separated from each other in the valve-rotational direction on the rotor planar surface, and communicates with the low-pressure gas chamber; and the low-pressure gas outflow port is formed in the valve rotor such that the outflow-port front edge line passes through the stator-recessed-portion front edge line and the low-pressure gas outflow port fluidally communicates with the stator recessed portion at a third phase of the valve rotation, and the outflow-port rear edge line passes through the stator-recessed-portion rear edge line and the low-pressure gas outflow port is fluidally separated from the stator recessed portion at a fourth phase of the valve rotation, and a shape of the outflow-port front edge line coincides with a shape of the stator-recessed-portion front edge line such that the outflow-port front edge line overlaps the stator-recessed-portion front edge line at the third phase.

6. The cryocooler according to claim 5, wherein the outflow-port front edge line and the stator-recessed-portion front edge line are each rectilinear.

7. The cryocooler according to claim 5, wherein a shape of the outflow-port rear edge line coincides with a shape of the stator-recessed-portion rear edge line such that the outflow-port rear edge line overlaps the stator-recessed-portion rear edge line at the fourth phase.

8. The cryocooler according to claim 7, wherein the outflow-port rear edge line and the stator-recessed-portion rear edge line are each rectilinear.

9. A rotary valve mechanism for a cryocooler having an axially oriented expander, the rotary valve mechanism defining a valve-rotational direction about a valve-rotational axis and the valve-rotational axis being orthogonal to the axial orientation of the expander, the rotary valve mechanism comprising:

a valve stator provided with a stator planar surface perpendicular to valve-rotational axis, and in the stator planar surface, a stator recessed portion defining a stator-recessed-portion front edge line and a stator-recessed-portion rear edge line located apart from each other in the valve-rotational direction, the valve stator being a portion of a working gas flow path of a cryocooler; and a valve rotor provided with a rotor planar surface perpendicular to the valve-rotational axis and in surface-contact with the stator planar surface, and in the rotor planar surface, a rotor recessed portion defining a rotor-recessed-portion front edge line and a rotor-recessed-portion rear edge line located apart from each other in the valve-rotational direction, the valve rotor being a portion of the working gas flow path of the cryocooler and being disposed such as to rotate with respect to the valve stator, about the valve-rotational axis; wherein the rotor recessed portion is formed in the valve rotor such that the rotor-recessed-portion front edge line passes through the stator-recessed-portion front edge line and the rotor recessed portion fluidally communicates with the stator recessed portion at a first phase of rotary-valve-mechanism rotation, and such that the rotor-recessed-portion rear edge line passes through the stator-recessed-portion rear edge line and the rotor recessed portion is fluidally separated from the stator recessed portion at a second phase of the rotary-valve-mechanism rotation, and a shape of the rotor-recessed-portion front edge line coincides with a shape of the stator-recessed-portion front edge line such that the rotor-recessed-portion front edge line overlaps the stator-recessed-portion front edge line at the first phase.

10. A cryocooler comprising the rotary valve mechanism according to claim 9.

* * * * *